US005743495A

United States Patent [19]

Welles, II et al.

[11] Patent Number: 5,743,495

[45] Date of Patent: Apr. 28, 1998

[54] SYSTEM FOR DETECTING BROKEN RAILS AND FLAT WHEELS IN THE PRESENCE OF TRAINS

[75] Inventors: Kenneth Brakeley Welles, II, Scotia; Irfan Ali, Schenectady, both of N.Y.

[73] Assignee: General Electric Company, Schenectady, N.Y.

[21] Appl. No.: 799,502

[22] Filed: Feb. 12, 1997

[51] Int. Cl.[6] ..... B61L 23/04

[52] U.S. Cl. ..... 246/121; 246/169 R

[58] Field of Search ..... 246/120, 121, 246/167 R, 169 R; 73/146, 488

[56] References Cited

U.S. PATENT DOCUMENTS

| | | | |
|---|---|---|---|
| 3,696,243 | 10/1972 | Risely | 246/121 |
| 4,306,694 | 12/1981 | Kuhn | 246/121 |
| 4,781,060 | 11/1988 | Berndt | 246/169 R |
| 5,397,083 | 3/1995 | Thomas | 246/121 |
| 5,462,244 | 10/1995 | Van Der Hoek et al. | 246/122 R |
| 5,529,267 | 6/1996 | Giras et al. | 246/120 |

*Primary Examiner*—S. Joseph Morano

*Attorney, Agent, or Firm*—Donald S. Ingraham; Douglas E. Stoner

[57] ABSTRACT

A redundant sensor system for predicting railway hazards including breaks in each rail, the location of the breaks, and determining when a railway vehicle has a flat wheel. Vibration sensors are distributed along both rails of a railway. Each sensor has a detection band at least within the sensing range of adjacent sensors and it is positioned such that the sensor detects vibration in both the horizontal and vertical axis of the rail. A central processor evaluates the data from these sensors and identifies the rail break, the location of the break, and the flat wheel.

18 Claims, 4 Drawing Sheets

SYSTEM FOR DETECTING BROKEN RAILS AND FLAT WHEELS IN THE PRESENCE OF TRAINS

BACKGROUND OF THE INVENTION

This invention relates to the detection of railway hazards in the presence of a train. More particularly this invention relates to a system and method for detecting a break in a rail line and detecting a flat railway vehicle wheel through the use of redundant vibration sensors.

Typical prior art systems for the detection of breaks in rails rely upon the detection of a break in electric current flow along the railway. Circuits operating in this manner are referred to as "broken rail" detection circuits. In this Specification, the term "railway" refers to the parallel tracks on which a railway vehicle may be situated. Optical measuring devices have also been utilized to detect buckles in the rail; for example, an optical signal is monitored so as to detect a shift in position of the railway. Because these techniques can be expensive and lack redundancy, there exists a need for a more economical and robust railway hazard detection system.

Railway sensors of the type described above often fail because they operate in a hostile environment. Normally the section of railway in which the sensor failed must be shut down for sensor repairs—a timely and costly process. Additionally, sensors on railways are becoming increasingly important as railway vehicle speeds increase. As such, there exists a need for highly reliable detection systems, such as can be presided by sensor redundancy in railway hazard detection systems.

Railcar defects can also adversely affect operations on a railway. For example, out-of-round railcar wheels (e.g. wheels having a "flat arc") present problems for the train and damage to the rails. Flat arcs result when a railway vehicle's wheel locks up as the vehicle is braking, resulting in the deformation of the wheel. Flat arcs on the railway vehicle wheel cause excessive vibration in the vehicle as the train rolls along the track. This vibration can lead to damage to the contents of the railway vehicle. As such it is desirable to detect the presence of flat arcs on railway vehicle wheels, referred to as "flat wheel detection."

SUMMARY OF THE INVENTION

The present invention addresses the foregoing needs by providing a system for predicting railway hazards utilizing vibration sensors comprising a plurality of vibration sensors respectively mounted on each respective rail on a railway to sense vibration on this railway from a railway vehicle moving along the railway. Each sensor on a respective rail is positioned such that the sensing range of any one sensor extends to a point along the rail that is also within the sensing range of at least one adjacent sensor so as to provide sensing coverage along the entire rail in the event a sensor fails.

Each of the sensors is electrically coupled to signal conditioning circuitry. Each of the signal conditioning circuits is electrically coupled to communications circuitry which communicates with a central processor. The central processor is adapted to collect data from each of the sensors along the railway and process this data so as to detect a break in a rail, the general position of the break, a flat arc on a railway vehicle wheel, and the railway vehicle within a train that has a flat arc.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
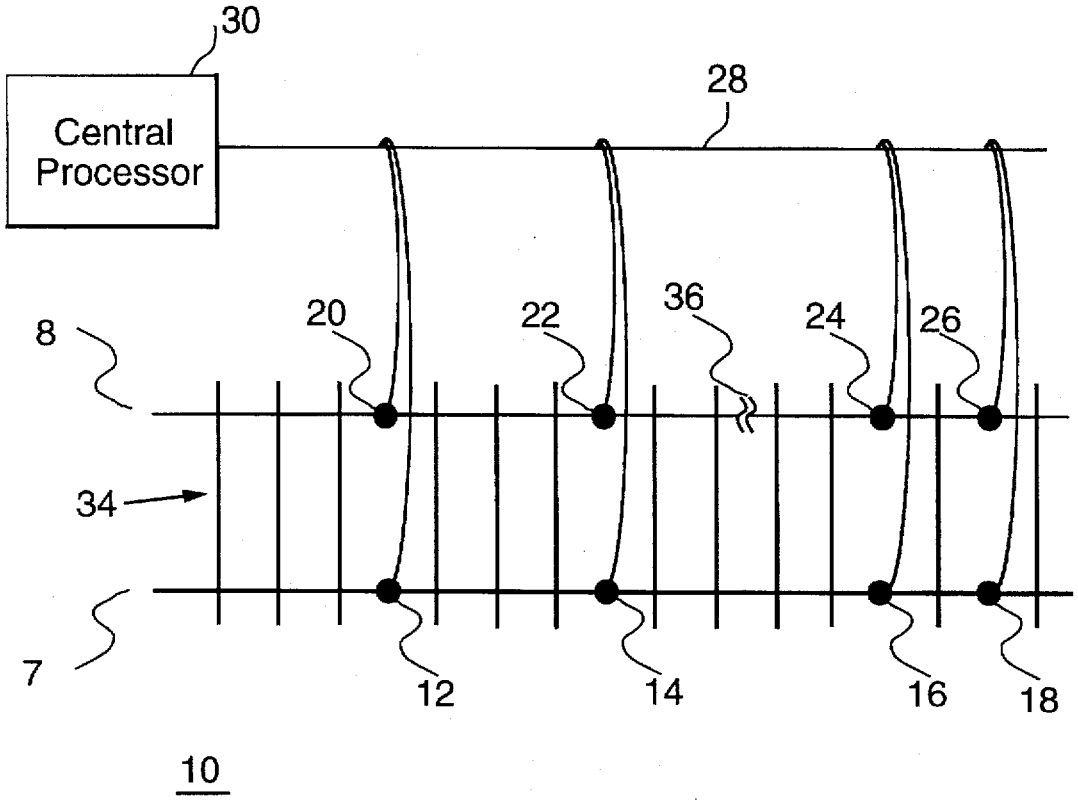
FIG. 1 is a schematic illustration of the present invention.

A railway hazard detection system 10 which detects railway hazards, including breaks in a railway and the location of a flat wheel on a railway vehicle, is illustrated in FIG. 1. The railway hazard detection system is comprised of a plurality of motion detection sensors (sensors 12, 14, 16, 18, 20, 22, 24, and 26), a central processor 30, and a coupling means 28 between the plurality of sensors and central processor 30.

Figure 2:
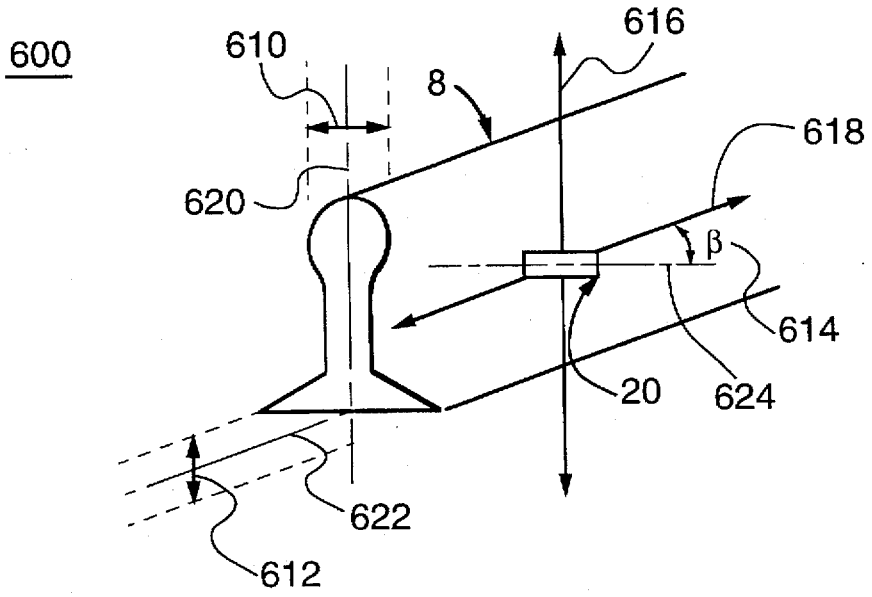
FIG. 2 illustrates the orientation of a sensor on a rail in the present invention.

A plurality of sensors (e.g., 12 through 26 in FIG. 1 ) in accordance with this invention are disposed at various positions along a monitored portion of the railway 34. In this Specification a monitored portion of railway 34 is defined as that portion of railway 34 in which at least two sensors within the sensing range of one another provide railway hazards detection as discussed below. Each sensor is coupled to one rail (e.g., rail 7 or 8 in FIG. 1 ) of railway 34 so as to detect movement of the rail. Such detection may comprise the detection of displacement 610 and 612 of the rail from reference positions 620 and 622 as illustrated in FIG. 2; alternatively detection may comprise sensing the velocity of a rail; a further alternative of detection is sensing the acceleration of a rail. Movement of the rail may be along the horizontal axis 618 and movement of the rail may be along the vertical axis 616 as is illustrated in FIG. 2.

In this Specification the phrase "vertical axis" 616 refers to the axis corresponding with the vertical height of a rail as illustrated in FIG. 2. The phrase "horizontal axis" 618 refers to the axis corresponding with the length of a rail (including a curved rail). The word "rail" refers to one of the parallel tracks on which a railway vehicle may be situated. A railway vehicle comprises one car of a train or one locomotive of a train. The word "train" refers to a plurality of railway vehicles connected together to a locomotive.

The sensing axis 624 of each sensor is additionally oriented at an angle in a range from between about 1 degree and about 10 degrees offset from the horizontal axis so that each sensor detects movement along horizontal axis 618 of each rail and movement along vertical axis 616 of each rail. For example, sensing axis 624 of sensor 20 is oriented at an angle "β" wherein "β" represents the angle of orientation of sensor 20 from horizontal axis 618 so that sensor 20 detects movement along horizontal axis 618 of rail 8 and movement along vertical axis 616 of rail 8 as is illustrated in FIG. 2.

Figure 3:
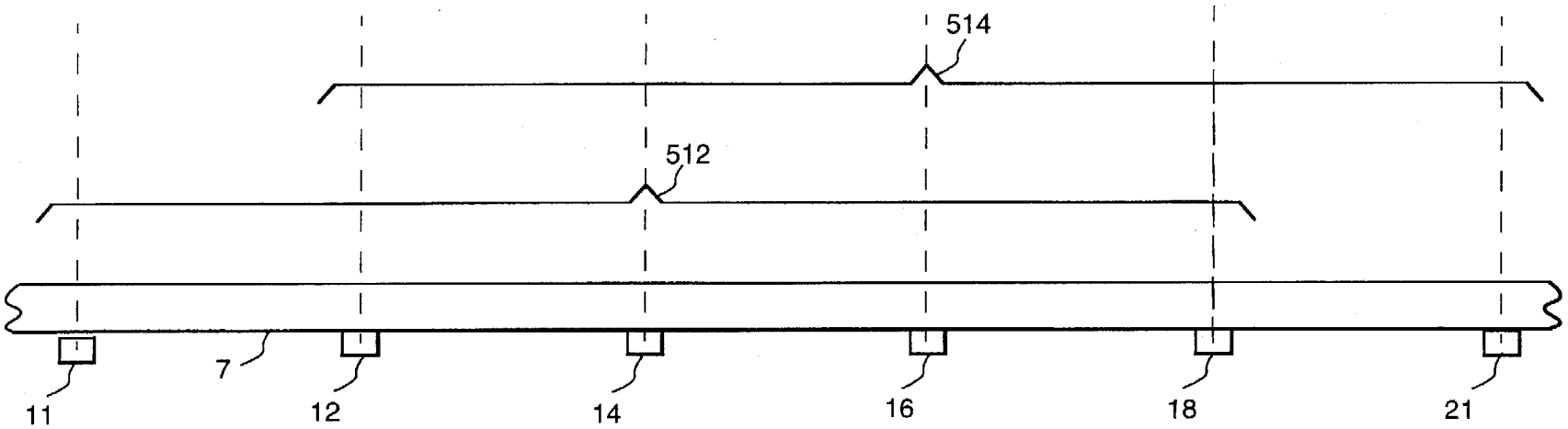
FIG. 3 illustrates sensor redundancy in accordance with the present invention.

In this invention each sensor is disposed along rail 34 such that any one sensor is within the sensing range of at least one adjacent sensor as illustrated in FIG. 3. Typically, each sensor has a detection band that nominally extends to two adjacent sensors on either side of the subject sensor. For example, the sensor detection band 512 of sensor 14 extends over sensors 11 and 12 on one side, and sensors 16 and 18 on the other side of sensor 14. Sensor 16 is disposed along rail 7 such that its sensor detection band 514 extends to sensors 12 and 14 on one side, and to sensors 18 and 21 on the other side of sensor 16. As such, detection band 512 and 514 overlap, and thus provide sensor detection redundancy. For example, in the event that sensor 14 fails, sensors 12 and 16 will detect the movement of the portion of rail 7 within the detection band of sensor 14.

The overlapping sensor detection bands ensure that in the event there is a failure of any one sensor, adjacent sensors will provide data sufficient to compensate for the failed sensor. Each sensor, except the end sensor, is disposed along a rail such that its sensor detection band extends nominally to four adjacent sensors, that is, the next two sensors on either side of the subject sensor. The end sensor is the sensor at either end of a plurality of sensors along rail 7. Each end sensor is typically disposed along rail 7 such that its sensor detection band extends to the next two sensors on one side of the subject sensor. For example, the end sensors illustrated in FIG. 1 are sensors 20 and 26 on rail 8 and 12 and 18 on rail 7.

Figure 4:
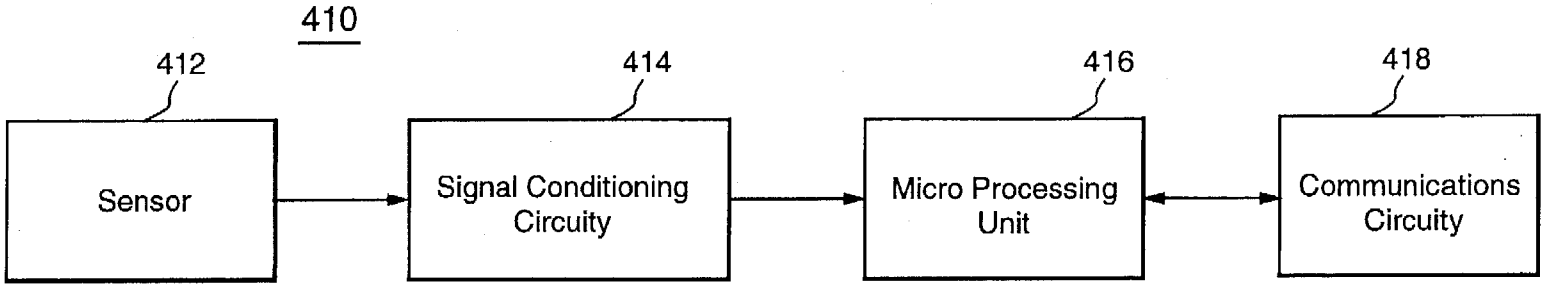
FIG. 4 is a block diagram of the sensor apparatus in accordance with the present invention.

Each sensor discussed above, (e.g. sensors 11, 12, 14, 16, 18, 20, 21, 22, 24, and 26 in FIG. 1) comprises a sensor apparatus 410 as illustrated in the block diagram of FIG. 4. Each sensor apparatus 410 typically comprises a motion detecting sensor 412, a signal conditioning circuit 414, a micro-processing unit 416, and a communications circuit 418. Motion detecting sensor 412 is electrically connected to signal conditioning circuitry 414. Signal conditioning circuitry 414 is electrically coupled to micro processing unit 416. Micro processing unit 416 is electrically coupled to communications circuitry 418 and is utilized to multiplex data between sensor apparatus 410 and central processor 30. Motion detecting sensor 412 converts mechanical energy into electrical signals. As discussed above, motion detecting sensor 412 detects displacement of rail 7, from substitute reference axes, for example, axis 620 and 622 as illustrated in FIG. 2. Alternatively, for example, motion detecting sensor 412 detects the velocity of rail 7. As a further alternative, for example, motion detecting sensor 412 detects the rate of change of velocity over time of rail 7, hereafter referred to as acceleration. By way of illustration and not limitation, sensor 412 is an accelerometer, for example model number ADXL50, manufactured by Analog Devices®.

Signal conditioning circuitry 414 filters the signal and shapes the sensor output signal such that it is compatible with micro processing unit 416. As an illustration, signal conditioning circuitry 414 converts the analog signal to a digital signal adaptable for use by micro processing unit 416. Micro processing unit 416 converts the sensor data into a format that is readily adaptable for transmission by communications circuitry 418 to central processor 30. Communication circuitry 418 then transmits sensor data to central processor 30 over communication link 28 as illustrated in FIG. 1.

An alternative embodiment of sensor apparatus 410 does not comprise micro processing unit 416. In this case sensor 412 is coupled to signal conditioning circuitry 414, which is coupled to communicating circuitry 418. As indicated above, micro processing unit 416 is only utilized during communication with central processor 30 when signal multiplexing is necessary because the number of sensors are greater than the number of communication channels. In this embodiment signal conditioning circuitry 414 is utilized to amplify sensor 412 signal output data. Alternatively signal conditioning circuitry 414 is utilized to digitize sensor 412 signal output data for transmission to central processor 30.

Central processor 30 typically comprises a processor adapted to accommodate a failure of any one of the plurality of sensors, the presence of a "flat wheel", a break in railway 34, and the location of the break. In this Specification the phrase "wheel" refers to the portion of the railcar wheel that normally rides on the rail. Central processor 30 processes data received from the plurality of sensors to determine the above railway hazards. Central processor 30, for example, comprises a personal computer.

Sensor communications link 28 as illustrated in FIG. 1 provides means for coupling sensor data to central processor 30. For example, link 28 comprises a wire. Alternatively link 28 comprises an optical fiber. Alternatively, link 28 comprises a radio frequency (RF) transmitter. One direction communication is provided by link 28 from sensor apparatus 410 (FIG. 4) to central processor 30. Link 28 alternatively provides two way communication between sensor apparatus 410 and central processor 30. One way communication is established when each of the plurality of sensors are directly coupled to central processor 30. In this configuration no control is necessary to multiplex sensor data to central processor 30. Two way communication is required when sensor data are multiplexed to central processor 30. Sensor data are multiplexed because there are more sensors than communication channels. When sensor data are multiplexed the transmission of data from each sensor is controlled by central processor 30, as such, two way communication is essential. The RF transmitter and the optical link may similarly be one way communication from sensor apparatus 410 to central processor 30. Alternatively, the RF transmitter and the optical link employ two way communication between apparatus 410 and central processor 30 as discussed above.

Central processor 30 detects sensor failure. By way of illustration, if one sensor fails, (e.g. sensor 14 of FIG. 3) central processor 30 is capable of detecting the failure because sensor 14 has a characteristic flat output while each adjacent sensor 16 and 12 has a normal envelope of vibration data as train 106, for example, travels past these sensors. After the flat output of sensor 14 exists for a predetermined time, for example, one minute, central processor 30 determines that sensor 14 has failed and generates a failed sensor output indication (not shown). Sensor data from sensors 12 and 16 are available to substitute for failed sensor 14. This feature enables the railway to be operable after a single sensor failure. A benefit of this sensor redundancy is that scheduled replacement of a failed sensor can be performed on the railway rather than the unscheduled emergency replacement of a failed sensor.

Figure 5:
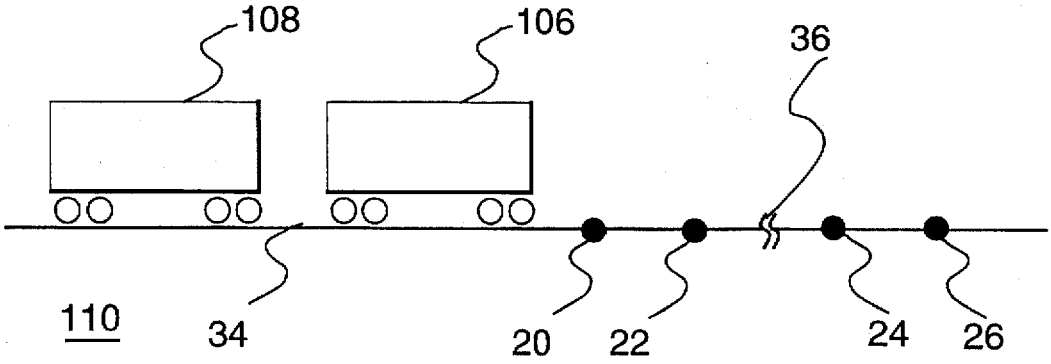
FIG. 5 illustrates a railway hazard in which there is a breach in a rail.
Figure 6:
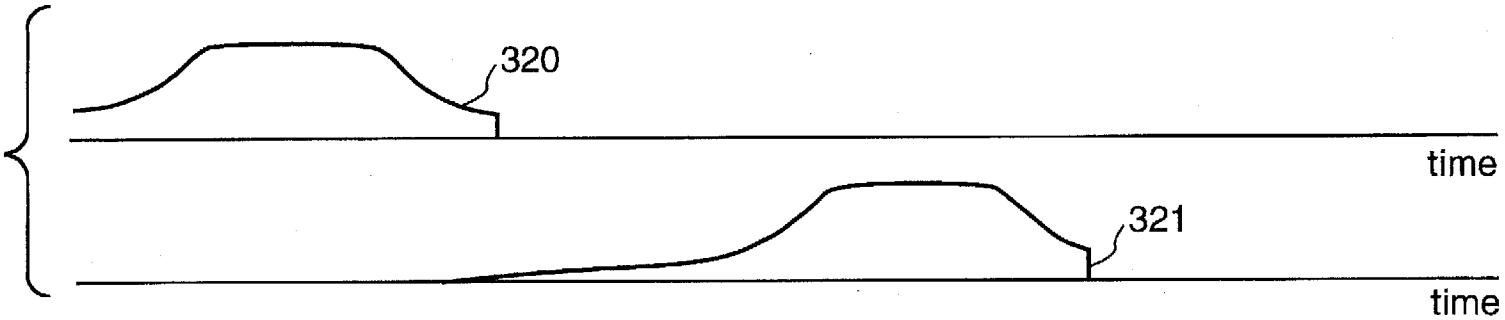
FIG. 6 illustrates typical vibration amplitude envelopes representing a break in the railway when a first and a second train approach and pass the break in the railway.

FIG. 6 illustrates the vibration energy over time as trains 106 and 108 (illustrated in FIG. 5) encounters sensor 20.

These graphs illustrate how the present invention detects break 36 in rail 8 in the presence of trains 106 and 108. As train 106 approaches sensor 20 the vibration amplitude of the envelope 320 rises as is illustrated in FIG. 6. As train 106 passes nearest to sensor 20 the vibration amplitude of envelope 320 is at its highest level. As train 106 moves away from sensor 20 the vibration amplitude of envelope 320 decreases until the last car of train 106 crosses break 36 in rail 8. Since vibration energy created when train 106 crosses break 36 is not transmitted across break 36, sensor 20 abruptly stops sensing the motion generated by train 106. Central processor 30 is adapted to determine the break in rail 8 by monitoring sensor data and generating a flag when there is a sudden drop in vibration amplitude. A sudden drop in vibration energy required for the detection of a break in a rail in this system is the detected vibration energy of a given sensor within a range between about ten percent and about twenty-five percent occurring within a time duration from about one second to about one minute. The time duration and the percent drop in energy is selected based on the sensitivity of the plurality of sensors employed and the transmitted vibration energy of a typical train on the sensor. For example, the percent drop will be about 25% within a time duration of about five seconds when accelerometers, model number ADXL50, manufactured by Analog Devices® are employed.

FIG. 6 also is a graph of the magnitude of the vibration energy over time as train 108 (illustrated in FIG. 5) encounters sensor 22. As train 108 approaches sensor 22 the vibration amplitude rises as is illustrated in the vibration amplitude envelope 321. As train 108 passes nearest to sensor 22 the vibration amplitude correspondingly nears its maximum level. As train 108 moves away from sensor 22 the vibration amplitude decreases until the last car of train 108 crosses a break 36 in the rail. Vibration energy created by train 108 is not transmitted across break 36; as such, sensor 22 abruptly stops sensing the vibration in correspondence with the movement of train 108. Central processor 30 is adapted to determine that a break has occurred in rail 8 by monitoring sensor 22 data for a sudden drop in vibration amplitude as defined above.

The present invention also detects break 36 when two trains are traveling on the same side of the break or on opposite sides of the break. Also the redundancy of adjacent sensors is illustrated.

Figure 7:
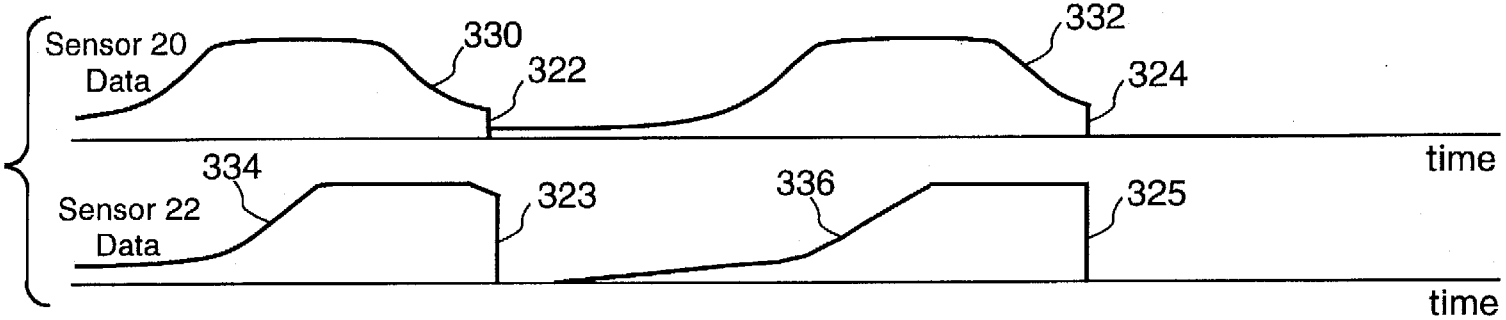
FIG. 7 illustrates typical vibration amplitude envelopes of the sensors located before the break in a railway when a first and a second train approach and pass the break in the railway.

For example, FIG. 7 is a graph of the magnitude of the vibration energy over time as trains 106 and 108 (FIG. 5) encounter sensors 20 and 22. The envelope 330 is the vibration amplitude of train 106 as it approaches, passes, and moves away from sensor 20. The envelope 332 is the vibration amplitude of train 108 as it approaches, passes, and moves away from sensor 20. The envelope 334 is the vibration amplitude of train 106 as it approaches, passes, and moves away from sensor 22. The envelope 336 is the vibration amplitude of train 108 as it approaches, passes, and moves away from sensor 22. Central processor 30 is adapted to determine break 36 in 8 by monitoring sensors 20 and 22 for a sudden drop in vibration amplitude of envelopes 330, 332, 334 and 336 as defined above because these envelopes should be gradually tapering down when instead a sudden drop occurs.

Another feature of this invention is the redundancy of sensors. The preceding two paragraphs illustrate that data from sensor 20 are used to detect break 36. Alternatively, data are used from sensor 22 to detect break 36. Any break that occurs within the sensing range of at least two sensors will be detected by sensors within that sensing range in the present invention. For example, given that sensor 20 has failed when trains 106 and 108 pass, central processor 30 uses data supplied by sensor 22 because these data are similar to that of sensor 20. Comparing sensor data illustrated in FIG. 7 demonstrates that envelopes 330 at time 322 from sensor 20 has a similar sudden drop-off as envelopes 334 at time 323 from sensor 22. Additionally, envelope 332 at time 324 from sensor 20 have a similar sudden drop as envelope 336 at time 325 from sensor 22. A failure in sensor 20 would be evidenced by a flat envelope of the vibration amplitude from sensor 20. At the same time the envelope of adjacent sensor 22 is the pattern as shown in the envelopes 334 and 336. Based on the above description, central processor 30 receives accurate information about break 36 in rail from sensor 22 to determine that break 36 exists.

Figure 8:
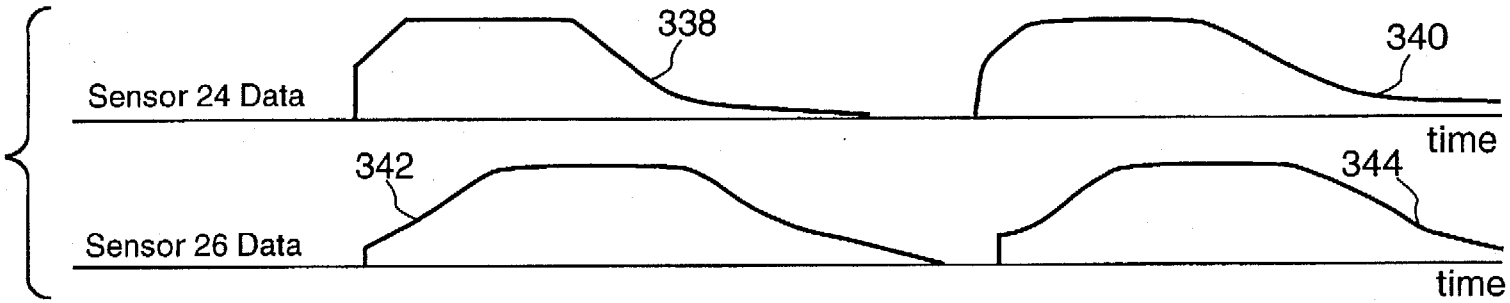
FIG. 8 illustrates typical vibration amplitude envelopes of the sensors located after the break in the railway when a first and a second train approach and pass the break in the railway.

FIG. 8 is a graph of the magnitude of the vibration energy over time as trains 106 and 108, illustrated in FIG. 5, encounter sensors 24 and 26. The envelope 338 is the vibration amplitude of train 106 as it approaches, passes, and moves away from sensor 24. The envelope 340 is the vibration amplitude of train 108 as it approaches, passes, and moves away from sensor 24. The envelope 342 is the magnitude of the vibration energy over time of train 106 as it approaches, passes, and moves away from sensor 26. The envelope 344 is the magnitude of the vibration energy over time of train 108 as it approaches, passes, and moves away from sensor 26. Central processor 30 is adapted to determine break 36 in rail 8 by monitoring sensor data from sensors 24 and 26 for a sudden rise in vibration amplitude of envelopes 338, 340, 342, and 344. A sudden rise in vibration energy typically refers to an increase in vibration energy detected by a respective sensor within a range between about ten percent and about twenty-five percent within a time duration between about one second and about one minute. The time duration and the percent increase in energy is selected based on the sensitivity of the plurality of sensors employed and the transmitted vibration energy of a typical train. For example, the change in vibrational amplitude over time is selected to be about 25% within a time duration of about five seconds when accelerometers, model number ADXL50, manufactured by Analog Devices® are employed.

A discussion of the redundancy of sensors 24 and 26 illustrated in FIG. 5 parallels the discussion of the redundancy of sensors 22 and 24. Just as was illustrated with sensors 22 and 24, signals from sensors 24 and 26 provide data that are redundant. For example, in the event that sensor 24 fails data from sensor 26 is utilized to identify break 36.

Central processor 30 is adapted to determine the position of a break to within a few sensor locations. The vibration amplitude envelope from sensors 20 and 22 located on one side of rail break 36 from which a train approaches have the general wave-form of envelopes 330 and 334, illustrated in FIG. 7. Changes in vibration amplitude identified by 322 and 323 is utilized to determine the general location of break 36. The vibration amplitude envelope from sensors 24 and 26 located on the opposite side of break 36 have the general wave-form of envelopes 338 and 342. Here there is a sudden rise in vibration energy. Break 36 lies between sensors which report these two different wave-forms, (i.e. a sudden drop and a sudden rise as defined above). For example, central processor 30 determines that rail break 36 exists by processing data illustrated by envelopes 334, 338, and 338. This data indicates that break 36 exists between sensors 22 and 24. Since sensor 22 is adjacent to sensor 24, central processor identifies the location of break 36 as between sensors 22 and 24. In the event that sensor 22 fails, central processor 30 is able to determine the location of break to within sensors 20 and 24 by the results from envelopes 330 and 338.

Central processor 30 is adapted to determine when there is a flat wheel on a moving railway vehicle by performing a frequency spectrum analysis on any one of the sensor signal data and determining frequency peaks at or near the expected frequency. The expected frequency is determined by dividing a predetermined expected speed of the railway vehicle by that vehicle wheel's circumference as is illustrated in the following equation;

$$F_e = v/(\pi d) \quad (1)$$

wherein "Fe" is the expected frequency, "v" is speed of the train in feet per second, and "d" is the diameter in feet of the wheel. The train speed is a predetermined number selected based on the average expected speed of trains in the sensing area. For example, the expected speed is 44 feet per second. "Fe" provides a number approximating the impact frequency of the flat wheel on the rail. The definition of "impact" in this Specification is when the flat portion of the railway vehicle wheel contacts the rail. As the flat wheel impacts the rail vibration energy is generated along vertical axis 618 of the rail, The vertical orientation of the sensor as described above detects this vertical motion. Central processor 30 determines a flat wheel by identifying when frequency spectrum peaks occur at the expected frequency. For example, when train 106, which has a flat wheel, is traveling at 30 miles per hour, and the diameter of the wheel is 2.33 feet, speed "v" is about 44 feet per second and expected frequency "Fe" is approximately 6 beats per second. When the amplitude of "Fe" is at least one and one-half times the amplitude of the surrounding noise within the frequency spectrum a flat wheel indication is generated.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A robust system for detecting railway hazards utilizing motion detecting sensors, the system comprising:

a plurality of motion detecting sensors disposed along a monitored portion of each rail of a railway to generate a respective motion signal in correspondence with rail movement induced by trains moving along said rail; and a central processor coupled to each of said motion detecting sensors along said monitored portion of each rail, said central processor being adapted to collect and process data from each of said motion detecting sensors so as to detect breaks in each of said rails;

each of said plurality of sensors on a respective rail being disposed at a distance from each adjacent one of said plurality of sensors such that a respective detection band of each of said plurality of sensors extends at least to an adjacent sensor so as to allow sensing redundancy within said plurality of sensors.

2. The railway hazards detection system of claim 1 wherein each of said motion detecting sensors comprises a displacement sensor so as to generate a respective sensor displacement signal in correspondence with rail displacement from reference axes, said rail movement being induced by trains moving along said railway.

3. The railway hazards detection system of claim 2 wherein each of said motion detecting sensors comprises a velocity sensor so as to generate a respective sensor velocity signal in correspondence with rail velocity, said rail movement being induced by trains moving along said railway.

4. The railway hazards detection system of claim 2 wherein each of said motion detecting sensors comprises an accelerometer so as to generate a respective sensor acceleration signal in correspondence with rail acceleration, said rail movement being induced by trains moving along said railway.

5. The railway hazards detection system of claim 4 wherein each of said plurality of motion detecting sensors are further mechanically coupled to said respective rail, wherein each of said plurality of sensors is disposed on said respective rail so as to detect horizontal motion and vertical motion of said respective rail.

6. The railway hazards detection system of claim 5 wherein said central processor is further adapted to detect a break in each of said respective rails in correspondence with changes in each of said respective sensors output amplitudes within a predetermined time period.

7. The railway hazards detection system of claim 6 wherein said central processor is further adapted to detect a break in at least one of said respective rails in correspondence with a respective sensor output amplitude increasing in a range between about ten percent and about twenty-five percent within a time period between about one second and about sixty seconds.

8. The railway hazards detection system of claim 7 wherein said central processor is further adapted to detect a break in each of said respective rails in correspondence with a respective sensor output amplitude decreasing in a range between about ten percent and about twenty-five percent within a time period between about one second and about sixty seconds.

9. The railway hazards detection system of claim 8 wherein said central processor is further adapted to determine the location of said break in each of said respective rails.

10. The railway hazards detection system of claim 9 wherein said system further comprises:

a plurality of sensor apparatuses, each of said sensor apparatuses comprising signal conditioning circuitry coupled to each of said plurality of sensors; and communications circuitry coupled to said signal conditioning circuitry wherein said communications circuitry for each sensor is adapted to communicate with said central processor.

11. The railway hazards detection system of claim 10 wherein each of said sensor apparatuses further comprises a micro processing unit coupled to said signal conditioning circuit, wherein said micro processing unit cooperates with said central processor to multiplex sensor data from said plurality of sensors to said central processor.

12. The railway hazards detection system of claim 11 wherein said communications circuitry is further adapted to maintain two-way communications with said central processor.

13. The railway hazards detection system of claim 10 wherein said central processor is adapted to detect flat wheels of a railway vehicle.

14. The railway hazards detection system of claim 13 wherein said central processor processes data to determine the presence of impact frequencies representing said respective flat wheels on said respective railway vehicle.

15. A method of predicting railway hazards in the presence of moving trains utilizing robust motion detecting sensors comprising the steps of:

sensing rail movement imposed on respective rails from said trains moving along said railway;

conditioning said sensor data for transmission to a central processor; and transmitting said sensor data to said central processor; and processing sensor data so as to detect a break in said respective rail, wherein said sensor output amplitude changes in a range between about ten percent and about twenty-five percent within a time period between about one second and about sixty seconds.

16. The method of claim 15 wherein said sensor output amplitude increases in a range between about ten percent and about twenty-five percent within a time period between about one second and about sixty seconds.

17. The method of claim 16 wherein said step of processing sensor data further comprises the step of processing data so as to determine the location of said break in said respective rail.

18. The method of claim 15 wherein said step of processing sensor data further comprises the steps of processing data so as to detect a flat arc on any one of said railway vehicle wheels by performing a frequency spectrum analysis on any one of said sensor's data.

* * * * *